US005567137A

United States Patent [19]

Nakashima et al.

[11] Patent Number: 5,567,137

[45] Date of Patent: Oct. 22, 1996

[54] SCROLL COMPRESSOR WITH SHAFT SEAL LUBRICATION

[75] Inventors: Masafumi Nakashima, Anjo; Takeshi Sakai, Chiryu; Yasushi Watanabe; Tetsuhiko Fukanuma, both of Kariya, all of Japan

[73] Assignees: Nippondenso Co., Ltd.; Kabushiki Kaisha Toyoda Jidoshokki, both of Kariya, Japan

[21] Appl. No.: 558,936

[22] Filed: Nov. 13, 1995

Related U.S. Application Data

[63] Continuation of Ser. No. 356,731, Dec. 15, 1994, abandoned.

[30] Foreign Application Priority Data

Dec. 16, 1993 [JP] Japan ..... 5-316762

[51] Int. Cl.[6] ..... F04C 18/04; F04C 27/00; F04C 29/02

[52] U.S. Cl. ..... 418/15; 418/55.4; 418/55.5; 418/55.6; 418/100

[58] Field of Search ..... 418/15, 55.4, 55.5, 418/55.6, 57, 100, 55.1

[56] References Cited

U.S. PATENT DOCUMENTS 5,240,392 8/1993 Fukanuma et al. ..... 418/55.6

FOREIGN PATENT DOCUMENTS 58-167893 10/1983 Japan ..... 418/55.5
60-135684 7/1985 Japan ..... 418/55.6
63-43424 11/1988 Japan .
2-27186 1/1990 Japan .
2-176179 7/1990 Japan ..... 418/55.5

*Primary Examiner*—John J. Vrablik
*Attorney, Agent, or Firm*—Cushman Darby & Cushman

[57] ABSTRACT

A scroll compressor for compressing a gaseous refrigerant including a lubricant in a mist state, having a stationary scroll member and a movable scroll member, which define pump chambers at an outer wall side of the movable scroll member and an inner wall side of the movable scroll member, which chambers are initially opened to an inlet port via a main intake passageway for introducing a gaseous refrigerant into the chambers when they are radially outwardly located. A sub-intake passageway, in which a shaft seal unit is provided, is diverted from the main intake passageway and is opened to the outer wall sided chamber before the chamber is sealingly closed so that a flow of gas, from the inlet port, is introduced into the chamber, the gas is positively fed to the shaft seal unit, and the shaft seal unit is lubricated.

7 Claims, 7 Drawing Sheets

Fig.5-A
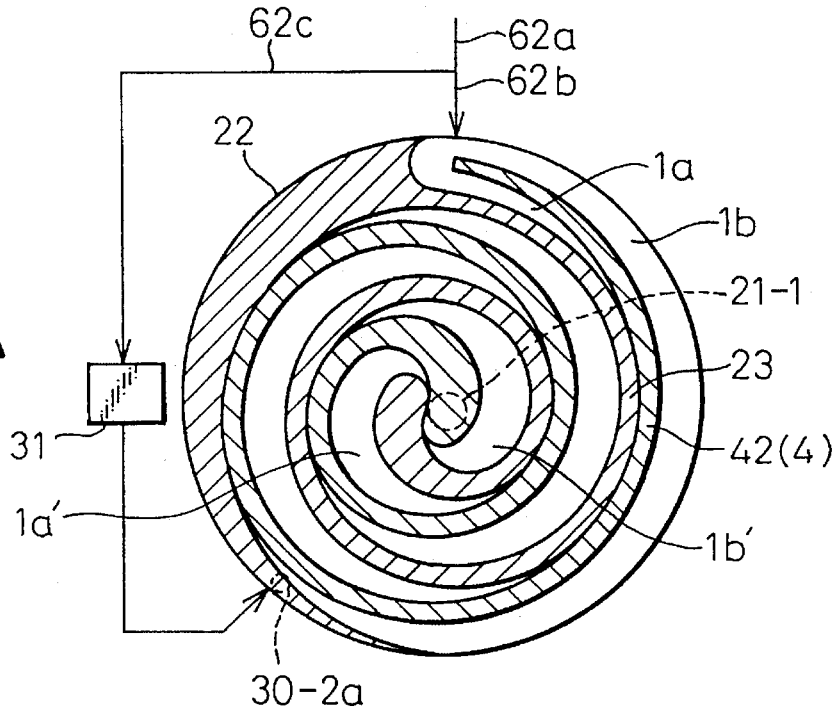
Fig.5-B
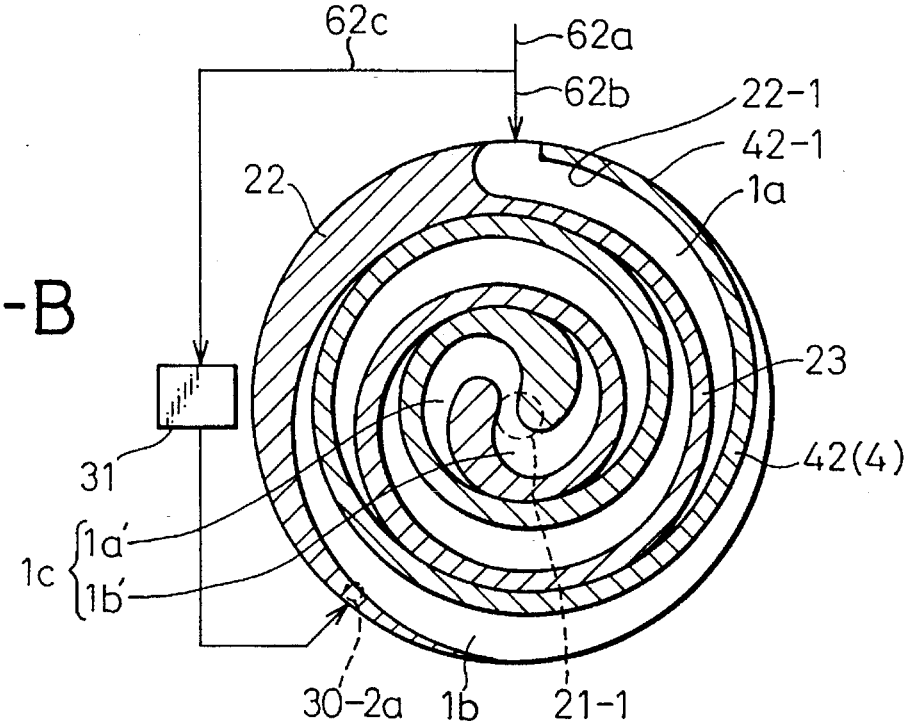

Fig.5-C
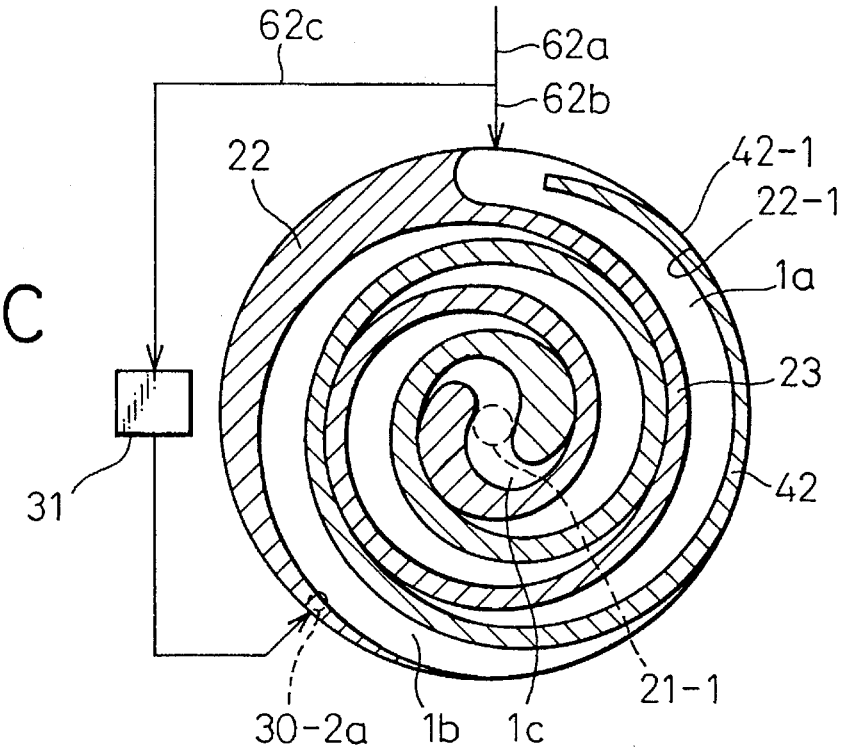
Fig.5-D
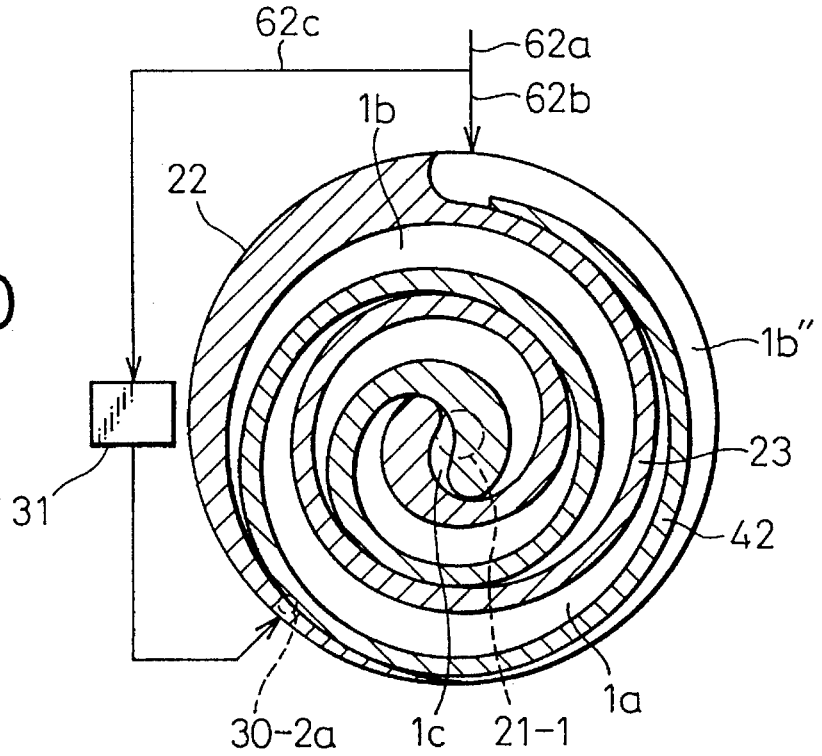

Fig.7-A
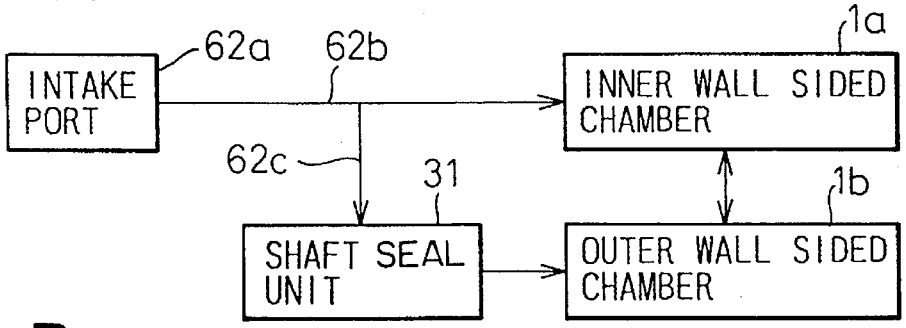
Fig.7-B
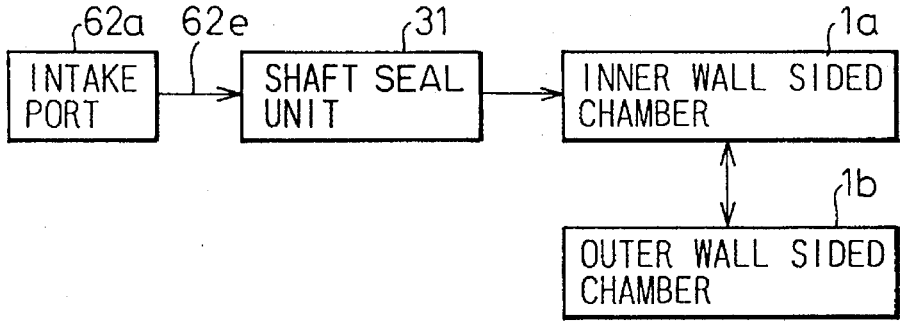
Fig.7-C
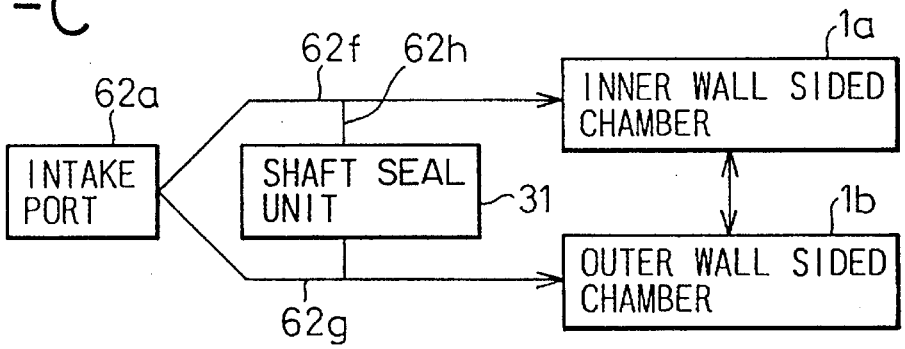
Fig.7-D
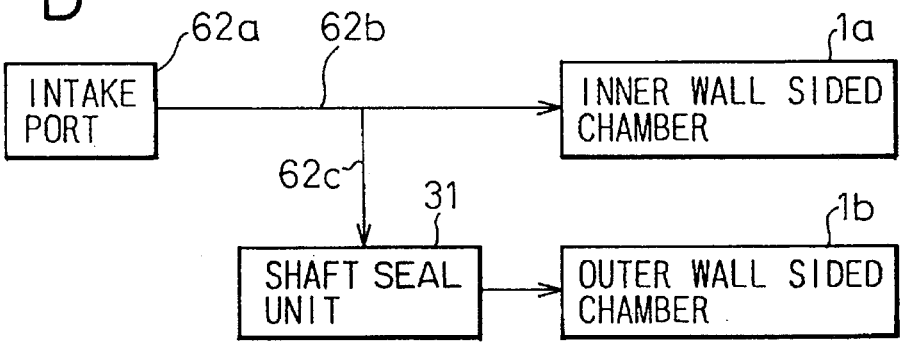

SCROLL COMPRESSOR WITH SHAFT SEAL LUBRICATION

This is a continuation of application Ser. No. 08/356,731, filed on Dec. 15, 1994, which was abandoned upon the filing hereof.

BACKGROUND OF THE INVENTION

1. Field of the Invention

The present invention relates to a scroll compressor with an improved lubrication system for a shaft seal unit.

2. Description of Related Art

The Japanese Un-Examined Utility Model Publication No. 63-43424 discloses a scroll compressor having a housing defining outer profile of the compressor and constructed by a front housing, a front end plate and a rear housing. The rear housing is formed with an inlet port for an introduction of a medium to be subjected to a compression and outlet port for a discharge of the medium after being compressed. Furthermore, to the rear housing, a stationary scroll member, which is constructed by a base plate and a scroll wall is fixedly connected. Arranged movably in the rear housing is a movable scroll member also constructed by a base plate and a scroll wall, in such a manner that a 180 degree phase difference is created between the stationary and movable scroll members, so that an outer wall side chamber is created on the outer side of the movable scroll member, and an inner wall sided chamber is created on the inner side of the movable scroll member. Furthermore, a drive shaft is rotatably supported on the front end plate by means of a seal member and a bearing member. The drive shaft has, at its inner end, a drive key, to which a drive bushing is fitted, on which bushing the movable scroll member is rotatably supported via a radial bearing, so that an orbital movement of the movable scroll member is obtained. Furthermore, a provision is also made as to means for preventing the movable scroll member from being rotated about its own axis. In this type of the compressor, the rear housing is formed with a main inlet passageway, which is in communication with the inner wall side chamber and outer wall side chamber before the chambers are sealingly closed for executing a compression operation. The prior art features that the front end plate and the rear housing form a sub inlet passageway which is branched from the main inlet passageway and which extends to the seal device.

In this type of the compressor, when a rotating movement is applied to the drive shaft from an outside source of the rotating movement, the drive key makes the drive bushing rotate. The rotation of the drive bushing is transmitted, via the radial bearing, to the movable scroll member. The self rotation blocking means prevents the movable scroll member from being rotated about its own axis, so that the movable scroll member can only execute an orbital movement. Due to the orbital movement of the movable scroll member, the inner wall sided compression chamber as well as the outer wall sided compression chamber, while the chambers are closed, are moved radially from their outermost positions to their innermost positions. At the innermost positions, both of the chambers are concentrated into a single compression chamber of a smaller volume opening to an outlet port. As a result, the refrigerant sucked from an inlet is discharged from the outlet port in a compressed condition.

In the '424 patent, the gaseous state refrigerant sucked into the chambers via the main inlet passageway is partly diverted into the shaft seal device via a sub inlet passageway. As a result, the shaft seal device is cooled by the gaseous refrigerant itself. Furthermore, the shaft seal device is lubricated by a lubricant in a mist condition included in the gaseous refrigerant. The lubricant also serves to lubricate the bearing units supporting the shaft.

However, in the prior art, the communication between the inlet port and the shaft seal unit is mainly through the sub intake passageway connecting the inlet port with the shaft seal unit. The shaft seal unit is, via gaps created between roller members in the bearing unit, also connected to the inner wall sided chamber as well as the outer wall sided chamber before they are sealingly closed for compression. However, such gaps provide a large flow resistance, on one hand, and the pressure difference between the inlet, the shaft seal device and the chambers before being sealingly closed is small, on the other hand. As a result, even after the gaseous refrigerant is contacted with the shaft seal unit, the large flow resistance as well as the small pressure difference make it difficult for the gas to be easily introduced into the inner and outer wall sided chambers. In other words, the introduction of the gaseous refrigerant into the inner wall sided compression chamber and outer wall sided compression chamber occurs only through the main intake passageway. This causes the shaft seal unit to be insufficiently cooled and lubricated, causing the lubrication of the bearing unit to be insufficient.

In view of this drawback, the Japanese Un-Examined Utility Model Publication No. 60-170088, the Japanese Un-Examined Patent Publication No. 62-132287, and the Japanese Un-Examined Patent Publication No. 2-27186 disclose compressors, wherein an oil separator or pump is provided, which allows the lubricant to be positively supplied to the shaft seal unit. However, such a provision of an oil separator or pump makes the system large, causing the installation of the system into an automobile to be difficult, on one hand, and the manufacturing cost to become high, on the other hand.

SUMMARY OF THE INVENTION

An object of the present invention is to provide effective lubrication for a shaft seal unit in a scroll compressor without increasing the size of the compressor and without increasing the production cost.

According to the present invention, a scroll compressor is provided, comprising:

a housing defining an inlet passageway for a gas including lubricant to be compressed and an outlet passageway for the liquid as compressed;

a drive shaft;

a bearing unit for rotatably supporting the drive shaft to the housing;

a shaft seal unit arranged adjacent the bearing unit for sealing the housing with respect to the shaft;

a stationary scroll member which is fixed to the housing, the stationary scroll member having a base plate and a scroll portion extending axially from the base plate;

a movable scroll member which is arranged movably in the housing and is arranged eccentric with respect to the drive shaft, the movable scroll member having a base plate and a scroll portion extending axially from the base plate;

a drive member connected to the shaft so that the drive member is eccentric with respect to the drive shaft, the drive member being rotatably connected to the movable scroll member, thereby obtaining an orbital movement of the movable scroll member about the axis of the shaft;

a mechanism for blocking the rotating movement of the movable scroll member about its own axis;

the scroll portion of the movable scroll member cooperating with the scroll portion of the stationary scroll member for creating pump chambers between the scroll members;

the orbital movement of the movable scroll member causing the pump chambers to be radially inwardly moved while the volume of the chambers becomes smaller, the chambers being in a communication with the inlet for receiving the gas when the chambers are located at radially outermost positions, the chambers being then sealingly closed for executing a compression of the gas therein while moving radially inwardly, the chambers being finally in communication with the outlet for discharging the compressed gas into the outlet when the chambers are located at radially innermost positions, and;

a sub-intake passageway for connecting, via said shaft seal unit, the inlet with at least one chamber before it is sealingly closed, thereby generating a flow of the gas and allowing the lubricant in the gas to positively contact the shaft seal unit.

BRIEF EXPLANATION OF ATTACHED DRAWINGS

FIGS. 5-A to 5-D illustrate positional relationships between the stationary scroll member and the movable scroll member at various angular positions during a rotation of the compressor.

Figure 1:
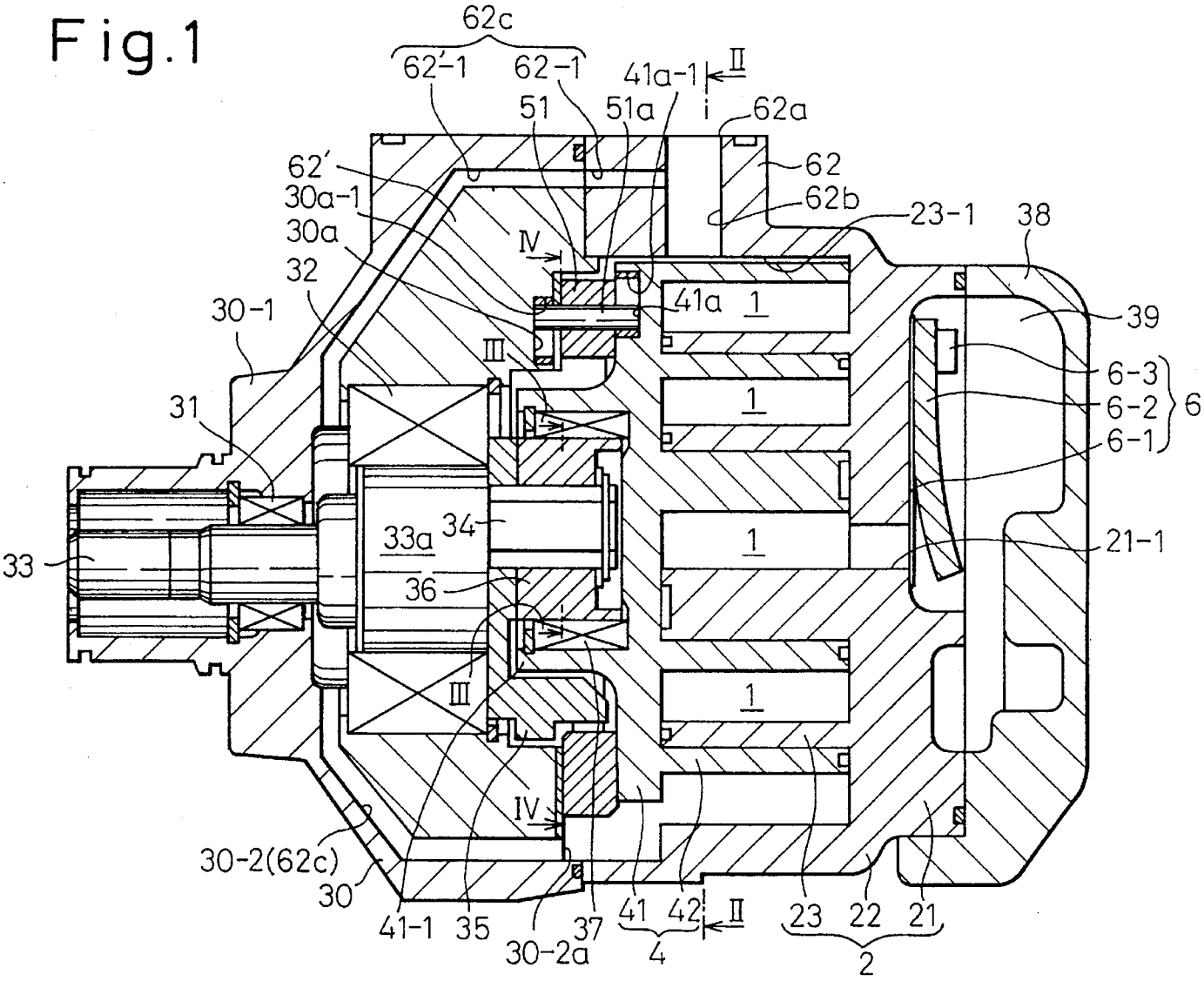
FIG. 1 is a longitudinal cross-sectional view of a scroll compressor according to the present invention.
Figure 6:
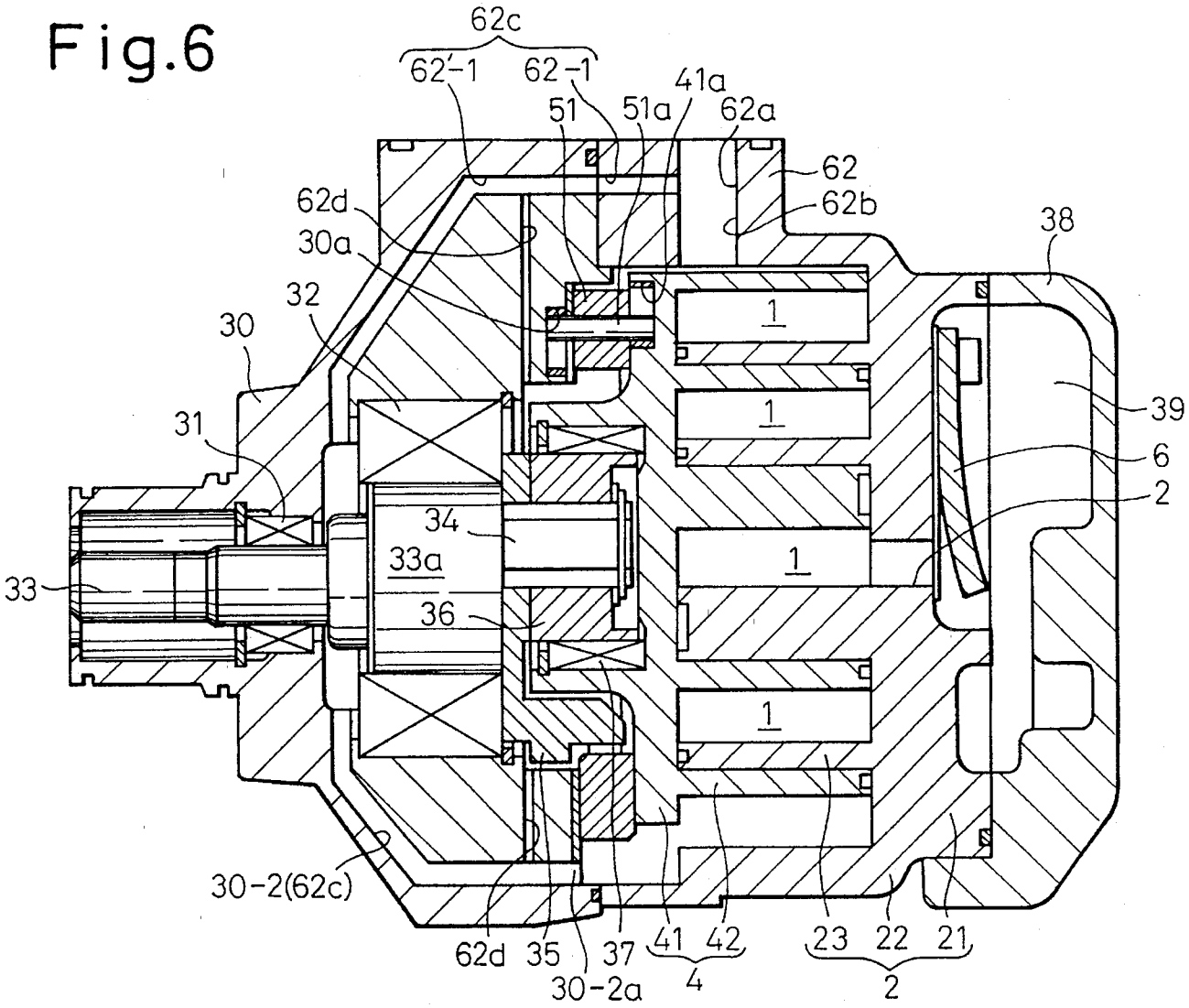

FIG. 6 is similar to FIG. 1, but illustrates a second embodiment of the present invention.

FIGS. 7-A to 7-D illustrate diagrammatically various arrangements for realizing the idea of the present invention.

DESCRIPTION OF PREFERRED EMBODIMENTS

Now, a first embodiment of the present invention will be explained with reference to FIGS. 1 to 5. In FIG. 1, the compressor includes a stationary scroll 2, which is constructed by a base plate portion 21, an outer shell portion 22 extending integrally from the side plate 21, and a scroll portion 23 which extends axially and is formed, for example, as an involute curve, and a movable scroll member 4, which is constructed by a base plate portion 41, and a scroll portion 42 which extends axially and is formed, for example, as an involute curve. The scroll portion 23 of the stationary scroll 2 and the scroll portion 42 of the movable scroll 4 are in side-by-side contact, while the axial ends of the scroll portions 23 and 42 of the scrolls 2 and 4 contact axially with the base plate 41 and 21 of the scroll 4 and 2, respectively, so that radially spaced compression chambers 1 are created between the movable and stationary scrolls 2 and 4.

Figure 2:
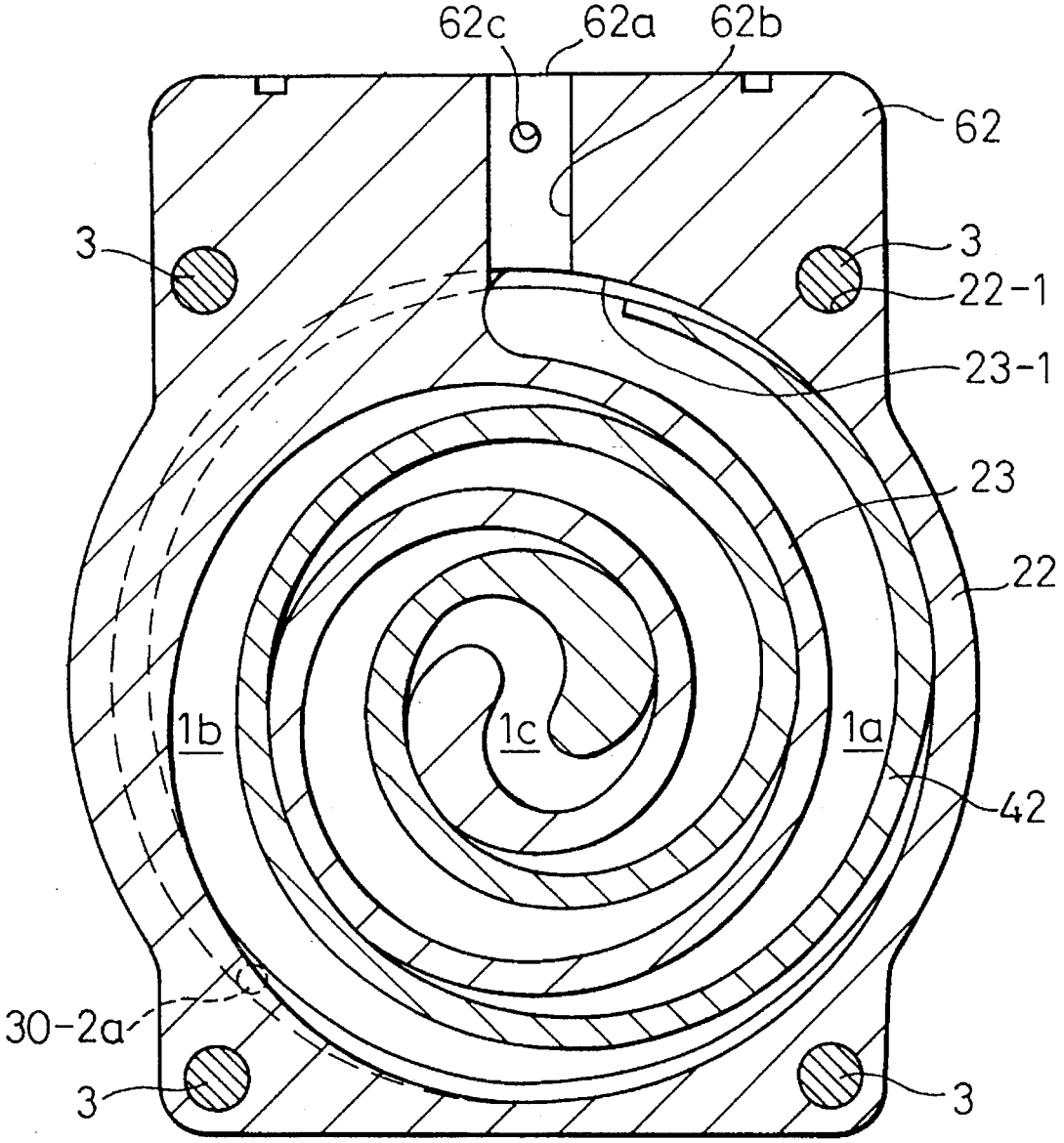
FIG. 2 is transverse cross-sectional view taken along line II—II in FIG. 1.

The construction of the compression chambers will now be explained in more detail. As shown in FIG. 2, the compression chambers 1 are divided into a first group of chambers 1*a* referred to as first chambers or inner wall sided chambers which are formed between the outer surface of the scroll portion 23 of the stationary scroll member 2 and an inner surface of the scroll portion 42 of the movable scroll member 4, and a second group of chambers 1*b* referred to as second chambers or outer wall sided chambers which are formed between the inner surface of the scroll portion 23 of the stationary scroll member 2 and an outer surface of the scroll portion 42 of the movable scroll member 4.

As shown in FIG. 2, the shell portion 22 of the stationary scroll 2 forms bores 22-1, through which bolts 3 pass for tightening the stationary scroll 2 to the front housing 30 as well as a rear housing 38 as shown in FIG. 1. The front housing 30 forms a boss portion 30-1, inside of which a shaft seal member 31 is arranged, through which seal member 31, a drive shaft 33 passes. The drive shaft 33 includes, at its inner end, an enlarged diameter portion 33*a*, on which a ball bearing unit 32 is inserted for rotatably supporting the drive shaft 33 with respect to the front housing 30. The drive shaft 33 is connected, via a clutch (not shown), to a rotating power source, such as an internal combustion engine.

Figure 3:
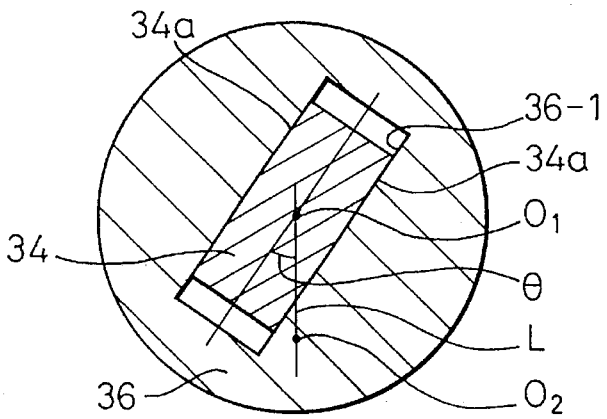
FIG. 3 is transverse cross-sectional view taken along line III—III in FIG. 1.
Figure 4:
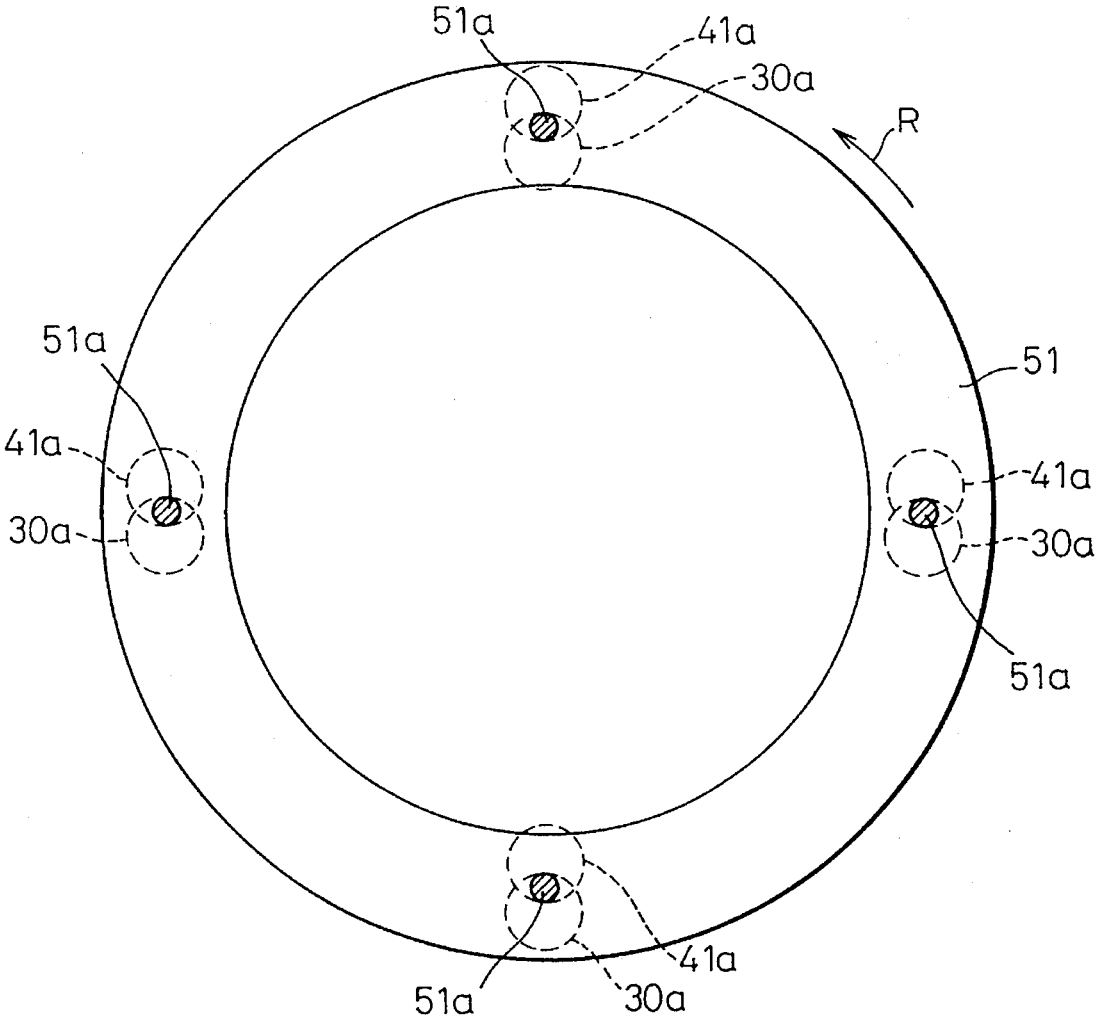
FIG. 4 is a view taken along a line IV—IV in FIG. 1.

A drive key 34 extends from the large diameter portion 33*a* at a location spaced from the axis of the shaft 33. Connected to the drive key 34 is a counter weight member 35 and a bushing 36, which are integral with each other. The base plate 41 of the movable scroll member 4 has, at a side opposite the scroll portion 42, a tubular boss portion 41-1, to which the drive bushing 36 is inserted via a bearing unit 37. As shown in FIG. 3, the bushing 36 has a groove 36-1 into which the drive key 34 is inserted. The drive key 34 has a pair of circumferentially spaced apart drive surfaces 34*a*, which are in radial sliding contact with the opposite drive force receiving surfaces of the groove 36-1. The drive surface 34*a* is inclined to a line L connecting the center $O_1$ of the bushing 36 and the center $O_2$ of the orbital movement of the bushing 36, i.e., the axis of the shaft 33 for an angle θ in a direction opposite to the rotation of the orbital movement. Due to such an inclined arrangement, a compression force generated in the compression chambers 1 causes the movable scroll member 4 to be radially moved with respect to the stationary scroll member 2, which causes the moveable scroll portion 42 to be positively engaged with the stationary scroll portion 23, thereby producing a desired self-sealing effect at the compression chambers 1.

As shown in FIG. 1, a movable ring 51 is arranged between the front housing 30 and the base plate 41 of the movable scroll 4. A plurality (at least three) of circumferentially spaced axially extending pins 51*a* are inserted to the ring 51, in such a manner that the pins 51*a*, at their opposite ends, extend out of the ring 51. Axially spaced opposite pairs of recess 30*a* and 41*a* are formed on the front housing 30 and the end plate 41, respectively. Liner rings 41*a*-1 made of a steel material are tightly fitted to the corresponding recess 41*a*, while steel rings 30*a*-1 are also tightly fitted to the corresponding recess 30*a*. The pin 51*a* contacts with the corresponding opposite pair of the recess 30*a* and 41*a* at diametrically opposite locations. As a result, radial forces from the drive shaft as well as the movable scroll member 4 are received by the pins 51*a*, which are equiangularly spaced, thereby preventing the movable scroll member 4 from being rotated about its own axis (axis of the bushing 36), while allowing the movable scroll member 4 to be rotated about the axis of the orbital movement (axis of the shaft 33). During the orbital movement of the movable scroll member 4, a rotation of the ring 51 of a radius which is half the eccentricity of the movable scroll member 4 (the distance between the axis of the shaft 33 and the axis of the bushing 36), is obtained. See FIG. 4. At the locations on the ring 51 with the self-rotation blocking pins 51*a*, the ring 51 creates, with respect to the faced surfaces of the front housing 30 and the movable scroll member 4, axial gaps of several 10 μm, which makes it possible for the pins 51*a* to receive the radial forces during the orbital movement of the movable scroll 4. Contrary to this, at locations of the ring 51 with no provision of the pins 51*a*, the ring 51 slidingly contacts with the faced surfaces of the front housing 30 and the movable scroll member 4, which makes it possible for the pins to receive the axial thrust force from the movable scroll member 4. In short, the pins 51*a*, the ring 51 and the limiting recess 30*a* and 41*a* construct a self-rotation blocking mechanism.

As shown in FIGS. 1 and 2, the shell portion 22 of the stationary scroll 2 and the front housing 30 form flange portions 62 and 62', which are in face to face contact. The flange 62 forms an inlet port 62*a*, which is in communication with a refrigerating system. Namely, the compressor is located in a refrigerating circuit at a location downstream from an evaporator for receiving a gaseous state refrigerant therefrom. As shown in FIG. 2, the flange portion 62 forms, at a location downstream from the intake port 62*a*, a main passageway 62*b* having a diameter, which is opened to an outer end of a recess 23-1 formed at the scroll section 23 of the stationary scroll member 2. As a result, communication of the main intake passageway 62*b* with the inner wall sided chamber or the outer wall sided chamber is obtained, when the chamber is radially outwardly located. As shown in FIG. 1, the flange portion 62 forms a hole 62-1 opened to the intake port 62*a*, while the flange portion 62' forms a hole 62'-1 having a first end in communication with the hole 62-1 and a second end opened to the shaft seal unit 31. The passage thus formed has a diameter smaller than the diameter of the main passageway 62*b*. Furthermore, the housing 30 is further formed with a hole 30-2 having one end opened to the shaft seal unit 31 and a second end 30-2*a*, opened to a space inside the housings 22 and 30. The passage thus formed directly connects the shaft seal unit 31 to the space. In other words, no intervening structure provides flow resistance. The end 30-2*a* is, as will be fully explained later, opened to the second chamber 1*b* when the latter is located at its outermost position before being sealingly closed to compress the gas. The openings 62-1, 62'-1 and 30-2*a* construct a sub-intake passageway 62*c* which allows the shaft seal unit 31 to be in communication with the first chamber 1*b* when the latter is located at its radially outermost position, i.e., before it is sealingly closed. Furthermore, as shown in FIG. 1, an outlet chamber 39 is formed between the scroll member 2 and rear housing 38. A delivery valve device 6 is arranged in the outlet chamber 39, and is constructed by a valve member 6-2 formed as a reed valve for normally closing an outlet port 21-2 formed in the base plate 21 of the stational scroll member 2, a stopper plate 6-2 for preventing the valve member 6-1 from being buckled, and a screw 6-3 for fixedly connecting the end of the valve member 6-1 away from the outlet port 21-1 together with the stopper member 6-2. The outlet chamber 39 is connected to a condenser (not shown) in the refrigerating circuit.

When the clutch (not shown) is engaged, the rotating movement of the crankshaft of the internal combustion engine is transmitted to the drive shaft 33, which causes the bushing 36 to be rotated via the drive key 34 which engages the driven groove 36-1 of the bushing 36. The rotating movement from the bushing 36 is transmitted to the movable scroll member 4 via the radial bearing unit 37, so that the movable scroll member 4 is rotated about the axis of the drive shaft 33 due to the eccentric arrangement of the drive key 34 with respect to the shaft 33. In this case, the self-rotation blocking mechanism constructed by the ring 51, the pins 51*a* and the recess 30*a* and 41*a* prevents the movable scroll member from being rotated about its own axis. In other words, an orbital movement of the movable scroll member 4 along a path about the axis of the shaft 33 is obtained without generating a rotational movement about its own axis. Such an orbital movement of the movable scroll member 4 causes the compression chambers 1 (first and second types of the chambers 1*a* and 1*b*) to be moved radially inwardly, while their volume is reduced.

Now, an operation of the compressor according to the first embodiment present invention will be fully explained with reference to FIGS. 5-A to 5-D, each of which shows, during a single rotation of the drive shaft 33, a mutual relationship between the scroll wall portion 23 of the stationary scroll 2 and the scroll wall portion 42 of the movable scroll member 4, while the intake port 62*a*, the main intake passageway 62*b*, the sub-intake passageway 62*c*, and the shaft seal unit 31 are diagrammatically illustrated for the sake of the simplicity. Namely, at an angular position of the movable scroll member 4 as shown in FIG. 5-A, the inner-wall sided (first) chamber 1*a* as well as the outer-wall sided (second) chamber 1*b*, which are located at their radially outermost positions, are opened to the main intake passageway 62*b*, i.e., they are not yet sealingly closed, so that an introduction of the refrigerant from the inlet port 62*a* is allowed via the main inlet passageway 62*b*. The sub-intake passageway 62*c* is also opened to the outer wall sided chamber 1*b* via the outlet hole 30-2*a*. Thus, a flow of the gas from the inlet 62*a* to the outer wall sided chamber 1*b* also occurs, via the sub-intake passageway 62*c*. The gas includes a mist state lubricant therein which function to lubricate the shaft seal member 31. In FIG. 1, the gas in the sub-passageway 62*c* is partly diverted to the bearing unit 32 as well as the self-rotation blocking mechanism including the ring 51 as well as the pins 51*a*, in order to lubricate the bearing as well as the self rotation blocking mechanism. The lubricant is, then, sucked into the chambers 1*a* or 1*b*, which are still under an intake pressure due to the fact that the chambers are still not sealingly closed.

In this condition in FIG. 5-A, the inner-wall sided chamber 1*a'* and the outer-wall sided chamber 1*b'*, which are located at their radially inward positions, are still closed and disconnected from the outlet port 21-1.

FIG. 5-B shows a position where the movable scroll member 4 has moved 90 degrees from the position in FIG. 5-A. In the position in FIG. 5-B or 5-C, the inner-wall sided chamber la is still opened to the main inlet passageway 62*b* so that the gas at the port 62*a* is introduced into the chamber 1*a* without substantially generating flow resistance, while the outer-wall sided chamber 1*b*, located radially outwardly, is disconnected from the communication with the main intake passageway 62*b*. Thus, a pressure reduction of the outer wall sided chamber 1*b* is insufficient to create the flow of the gaseous refrigerant into the chamber 1*b* via the sub-intake passageway 62*c*, so that an introduction of the gaseous state refrigerant into the chamber 1*b* does not take place. However, a lubrication condition of the shaft seal unit 31 is not worsened due to the lubricant supplied at the preceding phase in FIG. 5-A. In FIGS. 5-B and 5-C, it is possible to make a small clearance between the inner surface 22-1 of the shell 22 and outer surface 42-1 of the outermost lapping of the scroll portion 42 of the movable scroll member 4. This allows the chambers 1*a* and 1*b* to be communicated with each other via the gap, which prevent the outer wall sided chamber 1*b* from being sealingly closed, so that the pressure at the chamber 1*b* is still lower than the pressure at the intake port 62*a*. In this case, the outer wall sided chamber 1*b* is also under intake stroke, which allows the gas in the intake port 62*a* to be introduced into the chamber 1*b* via the sub intake passageway 62*c*. Thus, the shaft seal unit 31 opened to the sub-intake passageway 62*c* is more effectively supplied by the gas therein, thereby allowing the unit 31 to be cooled and lubricated.

In the position in FIGS. 5-B and 5-C, the innermost inner wall sided chamber 1*a*' and the innermost outlet wall sided chamber 1*b*' are integrated to a central chamber 1*c*, which is now opened to the outlet port 21-1, which allows the gas as compressed to be discharged to the outlet port 21-1.

In FIG. 5-D, which is a position rotated 90 degrees from the position in FIG. 5-C, the inner surface of the scroll wall 42 of the movable scroll member 4 contacts the outer surface of the scroll wall 23 of the stationary scroll member 2, so that the inner wall sided chamber 1*a* is sealingly closed. The outer wall sided chamber 1*b* is completely disconnected from the outlet hole 30-2*a* of the sub-intake passageway 62*c*, and thus contact between the outer surface of the scroll wall 42 of the movable scroll member 4 and the inner surface of the scroll wall 23 of the stationary scroll member 2 allows the outer wall sided chamber 1*b* to be sealingly closed. Thus, compression of the gas in the chambers 1*a* and 1*b* begins. In FIG. 5D, an outermost outer wall sided chamber 1*b*" is now being created, and the outlet hole 30-2*a* is about to be opened to the chamber 1*b*", thereby commencing the introduction of the gaseous refrigerant into the chamber 1*b*" via the sub-intake passageway 62*c*, thereby supplying lubricant to the shaft seal unit 31, as described above. In FIG. 5-D, the center chamber 1*c* has almost vanished, causing the discharge of the compressed refrigerant to stop. The steps of FIGS. 5-A to 5-D will be repeated for each rotation of the pump.

In short, according to the first embodiment, the provision of the sub-intake passageway 62*c* for connecting the main intake passageway 62*b* with the outer wall sided chamber 1*b* located at its radially outermost position before it is sealingly closed allows the gaseous refrigerant to positively flow through the sub-intake passageway 62*c*, thereby causing the shaft seal unit to be effectively supplied with the lubricant, thereby obtaining a reliable and sufficient cooling and lubrication of the shaft seal unit 31. As a result, an increased durability of the compressor is obtained. Furthermore, such improved lubrication of the shaft seal member 31 is obtained without increasing the resistance when the refrigerant is sucked, thereby obtaining an increased compression efficiency. Furthermore, according to the present invention, such an improved lubrication and the compression efficiency are obtained without the necessity of an independent oil separation unit or pump, thereby preventing the size of the system from being increased, which is suitable for a use in a limited space inside an automobile, on one hand, and is capable of reducing the production cost, on the other hand. Furthermore, according to the principle of the present invention, in order to supply the lubricant to the shaft seal unit, the refrigerant gas is not necessarily pressurized. If the gas supplied to the shaft seal unit is pressurized, the gas expands at the shaft seal unit and is re-compressed when introduced into the pump chamber. In other words, according to the present invention, such an unnecessary expansion of the gas which is followed by the compression of the gas is prevented, thereby increasing the efficiency. Furthermore, according to the present invention, no reduction in the cross sectional area of the intake port 62*a* is produced, thereby preventing the sucking resistance from being increased at the inlet port 62*a*, thereby maintaining an increased compression efficiency.

FIG. 6 shows a compressor of the second embodiment of the present invention, wherein the parts of the same functions as explained with reference to the first embodiment are designated by the same reference numbers. This embodiment is the same as the first embodiment except that a by-pass passageway 62*d* is additionally provided and the passageway has a first end connected to the hole 62-1' constructing the sub-intake passageway and a second end connected to the space inside the compressor at a location axially inward from the bearing 32 and outward from the self rotation blocking pins 51. The remaining construction is the same as the first embodiment.

In the second embodiment, the gaseous refrigerant at the intake port 62*a* is introduced, via the by-pass passageway 62*d*, into the space inside the pump housing, and, therefore, is sucked into the outermost outer-wall-sided chamber 1*b*, via the gap between inner surface 22-1 of the shell portion 22 and the outer surface 42-1 of the scroll wall 42 of the movable scroll member 4. In this case, prior to the introduction of the gaseous state refrigerant into the outermost inner-wall-sided chamber la and the outermost outer-wall-sided chamber 1*b* before they are sealingly closed, the gaseous state refrigerant in the space inside the pump housing can contact the bearing unit 32, so that the latter is cooled thereby, on one hand, and is lubricated by a mist state lubricant included in the gaseous refrigerant.

In short, the compressor in the second embodiment can operate to obtain the similar result, thereby effectively supplying the refrigerant gas into the bearing unit 32, the radial bearing unit 37 and the self-rotation blocking mechanism in order to lubricates these parts. Thus, an increased durability of the compressor is obtained.

FIGS. 7-A to 7-D schematically illustrate various versions of flow of refrigerant gas via the sub-intake passageway for lubricating the shaft seal unit 31. In FIG. 7-A, no intake resistance occurs between the inner-wall sided chamber la and the outer-wall sided chamber 1*b*. Namely, the intake port 62*a* is in communication with the inner-wall sided chamber 1*a* as well as the outer-wall sided chamber 1*b*. The sub-intake passageway 62*c* is diverted from the main intake passageway 62*b*, and connected to the outer-wall sided chamber 1*b* via the sub-intake passageway 62*c*, to create the flow of the gas contacting the shaft seal member 31. FIG. 7-B shows an arrangement when a sub-intake passageway 62*e* is provided, in which the shaft seal unit 31 is provided. The sub-intake passageway 62*e* is in a communication with the inner wall sided chamber 1*a* then with the outer wall sided chamber 1*b*. In FIG. 7-C, an intake passageway 62*f* is arranged for connecting the intake port 62*a* with the inner wall sided chamber 1*a* before it is sealingly closed, an intake passageway 62*g* is also arranged for connecting the intake port 62*a* with the outer wall sided chamber 1*b* before it is sealingly closed, and a sub-intake passageway 62*h* is provided between the passageways 62*f* and 62*g*, on which passageway 62*h*, the shaft seal unit 31 is provided. FIG. 7-D shows an arrangement, where an intake resistance is created between the inner-wall sided chamber 1*a* and the outer-wall sided chamber 1*b*. A sub-intake passageway 62*c*, in which the shaft seal unit 31 is located, is diverted from the main intake passageway 62*b* and is connected to the outer-wall sided chamber 1*b* before the latter is sealingly closed.

We claim:

1. A scroll compressor comprising:

a housing defining an inlet passageway for a gas including lubricant to be compressed and an outlet passageway for exhausting the gas;

a drive shaft;

a bearing unit for rotatably supporting the drive shaft in the housing;

a shaft seal unit arranged adjacent to the bearing unit for sealing the housing with respect to the shaft;

a stationary scroll member which is fixed to the housing, the stationary scroll member having a base plate and a scroll portion extending axially from the base plate;

a movable scroll member which is arranged movably in the housing and is arranged eccentric with respect to the drive shaft, the movable scroll member having a base plate and a scroll portion extending axially from the base plate;

a drive member connected to the drive shaft so that the drive member is eccentric with respect to the drive shaft, the drive member being rotatably connected to the movable scroll member, thereby obtaining an orbital movement of the movable scroll member about the axis of the shaft;

a mechanism for blocking the rotating movement of the movable scroll member about its axis;

the scroll portion of the movable scroll member cooperating with the scroll portion of the stationary scroll member for creating compression chambers between the scroll members;

the orbital movement of the movable scroll member causing the compression chambers to be radially inwardly moved while the volume of the chambers is reduced, the chambers being in direct communication with the inlet for receiving the gas from the inlet when the chambers are located at radially outermost positions, the chambers being then sealingly closed for executing a compression of the gas therein while moving radially inwardly, the chambers being finally in communication with the outlet for discharging the compressed gas into the outlet when the chambers are located radially at innermost positions; and a sub-intake passageway for connecting, via the shaft seal unit, the inlet with at least one of the chambers before the chamber is sealingly closed, thereby generating a flow of the gas, and allowing the lubricant in the gas to be positively contacted with the shaft seal unit, the sub-intake passageway comprising a first portion connecting the inlet with the shaft seal unit and a second portion connecting the shaft seal unit with at least one of the chambers, the second portion of the sub-intake passageway being directly opened to the at least one chamber.

2. A scroll compressor according to claim 1, further comprising a by-pass passageway diverting from the inlet passageway, the by-pass passageway being opened to a space inside the housing for lubricating the bearing unit and the blocking mechanism.

3. A scroll compressor according to claim 1, wherein the drive member is formed as a drive key which is fixedly connected to the shaft, and further comprising a bushing having a groove for receiving the drive key in a radially slidable manner, and wherein the movable scroll member is rotatably supported on the bushing.

4. A scroll compressor according to claim 1, wherein the housing defines an annular chamber between the bearing unit and the shaft seal unit, and wherein the first portion of the sub-intake passageway is opened to the annular chamber as its top and the second portion of the sub-intake passageway is opened to the annular chamber at its bottom.

5. A scroll compressor according to claim 1, wherein the first portion of the sub-intake passageway has a diameter smaller than a diameter the inlet passageway.

6. A scroll compressor comprising:

a housing defining an inlet passageway for a gas including a lubricant to be compressed and an outlet passageway for exhausting the gas;

a drive shaft;

a bearing unit for rotatably supporting the drive shaft in the housing;

a shaft seal unit arranged adjacent the bearing unit for sealing the housing with respect to the shaft;

a stationary scroll member which is fixed to the housing, the stationary scroll member having a base plate and a scroll portion extending axially from the base plate, the scroll portion of the stationary scroll member defining inner and outer scroll surfaces;

a movable scroll member which is arranged movably in the housing and is arranged eccentric with respect to the drive shaft, the movable scroll member having a base plate, and a scroll portion extending axially from the base plate, the scroll portion of the movable scroll member defining inner and outer scroll surfaces;

a drive key fixedly connected to the shaft so that the drive key is eccentric with respect to the drive shaft;

a bushing having a groove for radially slidably receiving the drive key, on which bushing the movable scroll member is rotatably supported, thereby obtaining an orbital movement of the movable scroll member about the axis of the shaft;

a mechanism for blocking the rotating movement of the movable scroll member about its own axis;

the scroll portion of the movable scroll member cooperating with the scroll portion of the stationary scroll member for creating a first compression chamber between the outer surface of the scroll portion of the stationary scroll member and the inner surface of the scroll portion of the movable scroll member, and a second compression chamber between the inner surface of the scroll portion of the stationary scroll member and the outer surface of the scroll portion of the movable scroll member;

the orbital movement of the movable scroll member causing the first and second compression chambers to be radially inwardly moved while the volume of the first and second chambers is reduced, the first and second compression chambers being in communication with the inlet for receiving the gas from the inlet when the first and second chambers are located at radially outermost positions, the first and second compression chambers then being sealingly closed for executing a compression of the gas therein while moving radially inwardly, the first and second compression chambers being finally integrated and in communication with the outlet for discharging the compressed gas when the first and second compression chambers are located at radially innermost positions; and a sub-intake passageway for connecting, via the shaft seal unit, the inlet with the second compression chamber before the second compression chamber is sealingly closed, thereby generating a flow of gas from the inlet to the second compression chamber, thereby allowing the lubricant in the gas to be positively contacted with the shaft seal unit, the sub-intake passageway comprising a first portion connecting the inlet with the shaft seal unit and a second portion connecting the shaft seal unit with the second compression chamber, the second portion of the sub-intake passageway being directly opened to the first and second compression chambers.

7. A scroll compressor according to claim 6, wherein the first portion of the sub-intake passageway has a diameter smaller than a diameter the inlet passageway.

* * * * *